US008330380B2

(12) United States Patent
Fujimura et al.

(10) Patent No.: US 8,330,380 B2
(45) Date of Patent: Dec. 11, 2012

(54) CONTROL CIRCUIT FOR LIGHT EMITTING DEVICE

(75) Inventors: Yoshio Fujimura, Ota (JP); Yusuke Nishizaki, Kitamoto (JP); Satoru Yoshioka, Gunma-ken (JP)

(73) Assignee: Semiconductor Components Industries, LLC, Phoenix, AZ (US)

( * ) Notice: Subject to any disclaimer, the term of this patent is extended or adjusted under 35 U.S.C. 154(b) by 230 days.

(21) Appl. No.: 12/757,197

(22) Filed: Apr. 9, 2010

(65) Prior Publication Data

US 2010/0259181 A1 Oct. 14, 2010

(30) Foreign Application Priority Data

Apr. 9, 2009 (JP) ..... 2009-094706
Apr. 9, 2009 (JP) ..... 2009-094707
Apr. 9, 2009 (JP) ..... 2009-094708

(51) Int. Cl.
*H05B 37/00* (2006.01)
*H05B 37/02* (2006.01)

(52) U.S. Cl. ..... 315/200 R; 315/291

(58) Field of Classification Search ..... 315/200 R, 315/203, 206, 209 R, 212, 247, 248, 254, 315/237, 238, 239, 272, 273, 274, 283, 290, 315/291, 307
See application file for complete search history.

(56) References Cited

U.S. PATENT DOCUMENTS 7,081,722 B1 * 7/2006 Huynh et al. ..... 315/323
7,564,198 B2 * 7/2009 Yamamoto et al. ..... 315/307
7,583,035 B2 * 9/2009 Shteynberg et al. ..... 315/307
7,852,300 B2 * 12/2010 Shteynberg et al. ..... 345/82

* cited by examiner

*Primary Examiner* — Minh D. A
(74) *Attorney, Agent, or Firm* — Cantor Colburn LLP

(57) ABSTRACT

A control circuit comprises a rectifier unit for performing full wave rectification on an AC power source, a switching element for switching a current flowing through a light emitting device which emits light in response to a voltage having been full wave rectified in the rectifier unit, a voltage dividing circuit for dividing the voltage having been full wave rectified in the rectifier unit to obtain a reference voltage Vref, a comparator for comparing a comparison voltage Vcmp corresponding to the current flowing through the light emitting device with the reference voltage Vref, and a control unit for controlling switching of the switching element based on a comparison result obtained in the comparator.

2 Claims, 13 Drawing Sheets

CONTROL CIRCUIT FOR LIGHT EMITTING DEVICE

CROSS-REFERENCE TO RELATED APPLICATIONS

The entire disclosure of Japanese Patent Application Nos. 2009-094706, 2009-094707 and 2009-094708 including specification, claims, drawings, and abstract is incorporated herein by reference.

BACKGROUND

1. Technical Field

The present invention relates to control circuits for controlling light emitting devices.

2. Related Art

Lighting systems have been developed in which light emitting diodes (LEDs) are used as light emitting devices for use in lighting.

FIG. 11 shows a control circuit 100 for a conventional lighting system. The control circuit 100 has a configuration in which a rectifier unit 10, a rectifier capacitor 12, a choke coil 14, a regenerative diode 16, a switching element 18, a control unit 20, and a comparator 22 are contained.

When AC power is supplied to the rectifier unit 10, full wave rectification is applied to the AC power. A full wave rectified voltage is smoothed by the rectifier capacitor 12, and subsequently supplied to the control unit 20 as a source voltage, and to an anode terminal of an LED 102 as a drive voltage. A cathode of the LED 102 is connected via a series connection of the choke coil 14, the switching element 18, and a resistance element R1 to ground. In response to switching operation of the switching element 18 controlled by the control unit 20, an electric current is passed, via the choke coil 14, the switching element 18, and the resistance element R1, through the LED 102, thereby causing the LED 102 to emit light. Further, the regenerative diode 16, which transfers energy having been accumulated in the choke coil 14 to the LED 102 for regenerative use when the switching element 18 is turned off, is connected in parallel to the LED 102 and the choke coil 14.

The comparator 22 receives input of both a comparison voltage Vcmp generated across the resistance element R1 by the current flowing through the LED 102 and a fixed reference voltage Vref obtained by dividing, among resistances, a voltage Vreg generated in the control unit 20 that has received the smoothed power. The control unit 20 controls switching of the switching element 18 based on a result of comparison between the reference voltage Vref and the comparison voltage Vcmp performed in the comparator 22. The control unit 20 turns on the switching element 18 to allow a flow of the current through the LED 102 when the comparison voltage Vcmp is lower than the reference voltage Vref, and turns off the switching element 18 to interrupt the current to the LED 102 when the comparison voltage Vcmp becomes higher than the reference voltage Vref.

As described above, an average emission intensity of the LED 102 can be adjusted by controlling the flow of the current through the LED 102.

However, the above-described control circuit 100 in related art suffers from a problem that it is not possible to increase a power factor because, as shown in FIG. 12, the AC voltage to be input and the current flowing through the LED 102 are out of phase due to the fact that the reference voltage Vref is a constant voltage.

Meanwhile, dimmer systems for incandescent light bulbs in which the emission intensity (brightness) can be adjusted have been utilized. In the dimmer systems for the incandescent light bulbs, as shown in FIG. 13, the emission intensity is adjusted by controlling a conduction angle of AC power so as to reduce an average value of the current flowing through the incandescent light bulb.

On the other hand, there has been a desire for a system which is capable of adjusting the emission intensity also in a case where an LED is used as the light emitting device. Conventionally, a processing circuit for converting an alternating current voltage into a digital voltage signal and a circuit for detecting a time when the alternating current voltage is shut off and stopping oscillation of an inverter at the detected time are used in the dimmer system for the LED.

However, it is necessary to install the above-described circuits as different circuits independent of the system for the incandescent light bulbs which has been conventionally provided as facilities of an accommodation unit. In addition, each of the circuits is relatively large in size. For this reason, the circuits used as a control system for the LED have problems such as increased manufacturing costs.

Therefore, it is desired to provide a control circuit capable of adjusting light intensity of an LED by means of a conventional light intensity adjusting circuit designed for the incandescent light bulbs.

Further, the conventional light intensity adjusting circuit for the incandescent light bulbs has a different minimum output voltage for each manufacturer. In other words, control ranges of the conduction angle of the alternating current voltage differ among the light intensity adjusting circuits, which results in mixed presence of the light intensity adjusting circuits such as those having a minimum output voltage of 30 V, or those having a minimum output voltage of 60 V.

For example, it is assumed that a control circuit for controlling switching of an LED is configured so as to match a voltage adjustable range in a light intensity adjusting circuit whose minimum output voltage is 30 V (i.e. the voltage adjustable range of from 30 V to a maximum output voltage). If the control circuit is applied to another light intensity adjusting circuit whose minimum output voltage is 60 V, in spite of the fact that light intensity of the LED can be adjusted at voltages in a range of from 30 V to 60 V with the control circuit, the voltages in the range are unavailable in the light intensity adjusting circuit, which results in a problem that light produced by the LED cannot be adjusted to a state of minimum light intensity (a darkest state), or the like. On the other hand, when the control circuit for controlling switching of the LED is configured so as to match a voltage adjustable range in a light intensity adjusting circuit whose minimum output voltage is 60 V (i.e. the voltage adjustable range of from 60 V to the maximum output voltage), application of the control circuit to another light intensity adjusting circuit whose minimum output voltage is 30 V brings about a problem that switching control performed by the control circuit becomes unstable at voltages ranging from 30 V to 60 V.

In this respect, it is also desired to provide a control circuit capable of adjusting light of an LED to the state of minimum light intensity (the darkest state) regardless of which light intensity adjusting circuit is used, and regardless of the minimum output voltage of the light intensity adjusting circuit.

SUMMARY

In one aspect of the present invention, there is provided a control circuit for a light emitting device comprising a rectifier unit for performing full wave rectification on an alternating current power source, a switching element for switching a current flowing through the light emitting device that emits light in response to a voltage having been full wave rectified in the rectifier unit, a voltage dividing circuit for dividing the voltage having been full wave rectified in the rectifier unit, to obtain a reference voltage, a comparator for comparing a comparison voltage corresponding to the current flowing through the light emitting device with the reference voltage, and a control unit for controlling switching of the switching element based on a comparison result obtained in the comparator.

In another aspect of the present invention, there is provided a control circuit for a light emitting device comprising a rectifier unit for performing full wave rectification on an alternating current power source, a capacitor for smoothing a voltage having been full wave rectified in the rectifier unit, a switching element for switching a current flowing through the light emitting device which emits light in response to the smoothed voltage, a voltage dividing circuit for dividing the smoothed voltage to obtain a reference voltage, a comparator for comparing a comparison voltage corresponding to the current flowing through the light emitting device with the reference voltage, and a control unit for controlling switching of the switching element based on a comparison result obtained in the comparator.

In a further aspect of the present invention, there is provided a control circuit for a light emitting device comprising a rectifier unit for performing full wave rectification on an alternating current power source, a capacitor for smoothing a voltage having been full wave rectified in the rectifier unit, a first switching element for switching a current flowing through the light emitting device which emits light in response to the smoothed voltage, a voltage dividing circuit including a zener diode which interrupts the voltage dividing circuit when the smoothed voltage becomes lower than or equal to a first voltage, and dividing the smoothed voltage to output a reference voltage when the smoothed voltage is higher than the first voltage, a comparator for comparing a comparison voltage corresponding to the current flowing through the light emitting device with the reference voltage, and a control unit for controlling switching of the first switching element based on a comparison result obtained in the comparator.

BRIEF DESCRIPTION OF THE DRAWINGS

Preferred embodiments of the present invention will be described in detail based on the following figures, wherein.

DETAILED DESCRIPTION

<Embodiment 1>

Figure 1:
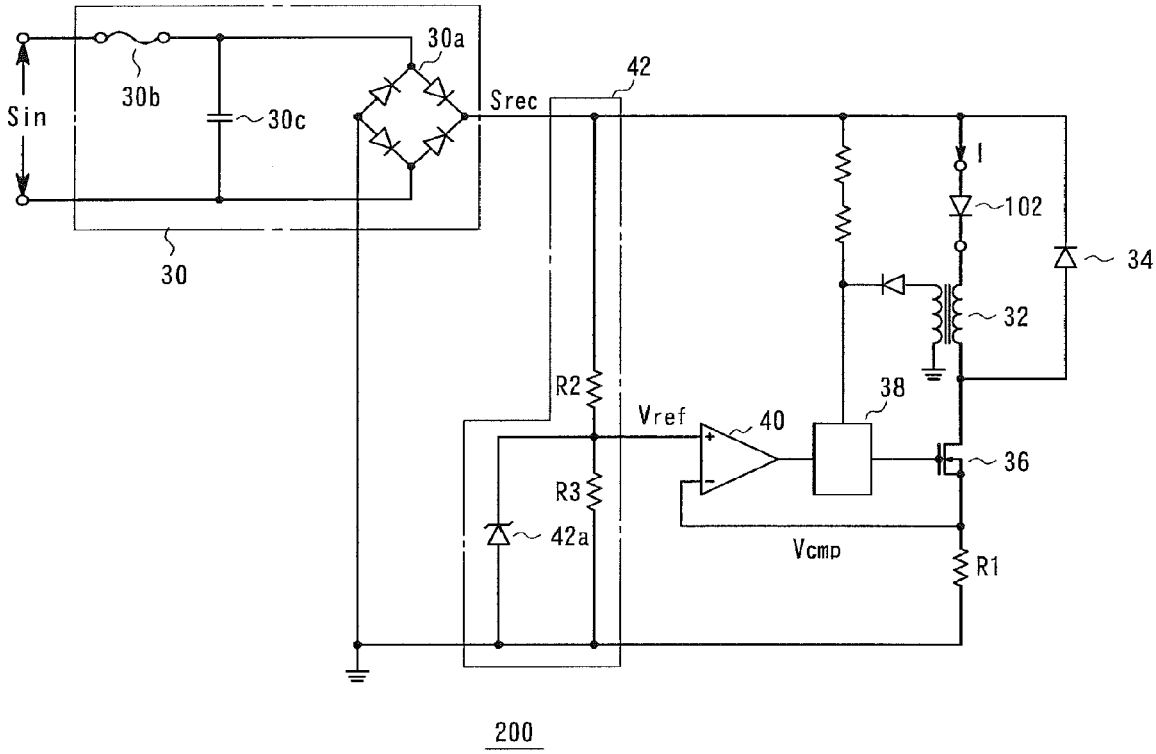
FIG. 1 shows a configuration of a control circuit for a light emitting device according to a first embodiment of the present invention.
Figure 2:
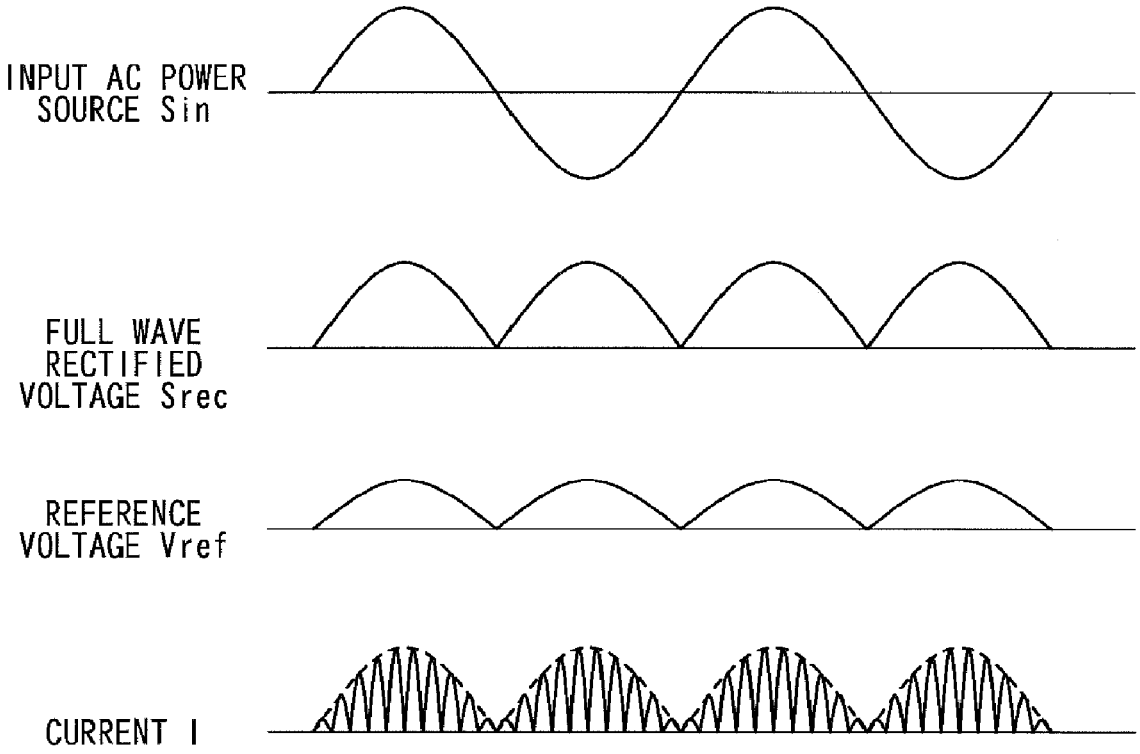
FIG. 2 shows operation of the control circuit for the light emitting device according to the first embodiment.

A control circuit 200 for a light emitting device according to Embodiment 1 of the present invention includes, as shown in FIG. 1, a rectifier unit 30, a choke coil 32, a regenerative diode 34, a switching element 36, a control unit 38, a comparator, and a voltage dividing circuit 42. Further, the voltage/current of each unit in the control circuit 200 according to this embodiment is shown in FIG. 2.

The control circuit 200 controls light emission of a light emitting device. For example, the control circuit 200 is connected to a light emitting diode (LED) 102 for use in lighting, to control flow of current to the LED 102.

The rectifier unit 30 includes a rectifier bridge circuit 30*a*. The rectifier unit 30 receives an alternating current voltage Sin, and full wave rectifies the alternating current voltage Sin to output the voltage as a full wave rectified voltage Srec. As shown in FIG. 1, a fuse 30*b* used for protection or a filter 30*c* used for noise reduction may be installed in the rectifier unit 30.

Further, in this embodiment, a rectifier capacitor 12 having a large capacitance is not installed, or only a small-capacitance capacitor such as a film capacitor which does not function as the rectifier capacitor 12 is installed in a subsequent stage of the rectifier unit 30. As a result, the full wave rectified voltage Srec which is not smoothed is applied as a drive voltage to an anode terminal of the LED 102 and applied as a power source voltage to the control unit 38.

The anode terminal of the LED 102 is supplied with the full wave rectified voltage Srec. A cathode terminal of the LED 102 is connected to ground via the choke coil 32, the switching element 36, and a voltage detecting resistance R1.

The choke coil 32 is installed for the purpose of shaping the current which flows through both the LED 102 and the switching element 36 in the form of an interrupted current. As shown in FIG. 1, a forward winding may be installed in the choke coil 32 to allow additional provision of the power source voltage to the control unit 32.

The switching element 36 is installed to supply or interrupt the current to the LED 102. The switching element 36 is configured as an element which has a capacitance corresponding to power consumption of the LED 102, and may be implemented, for example, by a power field effect transistor having high power or the like. Switching of the switching element 36 is controlled by the control unit 38.

The regenerative diode 34, which is a flywheel diode, is connected in parallel with the LED 102 and the choke coil 32. The regenerative diode 34 sends energy having been accumulated in the choke coil 32 to the LED 102 for regenerative use when the switching element 36 is switched off.

The voltage dividing circuit 42 divides the full wave rectified voltage Srec obtained from the rectifier unit 30 to generate a reference voltage Vref, and outputs the reference voltage Vref to the comparator 40. The voltage dividing circuit 42 may be composed of, for example, resistances R2 and R3 connected in series. The full wave rectified voltage Srec is divided between the resistances R2 and R3, and a terminal voltage of the resistance R3 is input as the reference voltage Vref to a non-inverting input terminal of the comparator 40.

Due to the voltage dividing circuit 42, the reference voltage Vref exhibits a change in proportion to a change in the full wave rectified voltage Srec as shown in FIG. 2.

The comparator 40 receives, at its inverting input terminal, a comparison voltage Vcmp which is generated across the voltage detecting resistance R1 by the current flowing through the LED 102. Further, the comparator 40 also receives, at the non-inverting input terminal thereof, the reference voltage Vref obtained by dividing, in the voltage dividing circuit 42, the full wave rectified voltage Vrec which is not smoothed. The comparator 40 compares the comparison voltage Vcmp with the reference voltage Vref and outputs a result of the comparison to the control unit 38.

The control unit 38 controls switching of the switching element 36 based on the result of the comparison between the reference voltage Vref and the comparison voltage Vcmp performed by the comparator 40. The control unit 38 is configured as a semiconductor integrated circuit. The control unit 38 turns on the switching element 36 to feed the current to the LED 102 when the comparison voltage Vcmp is lower than the reference voltage Vref, and turns off the switching element 36 to interrupt the current to the LED 102 when the comparison voltage Vcmp becomes higher than the reference voltage Vref.

As shown in FIG. 2, by the action of the comparator 40 and the control unit 38 as described above, the current I flowing through the LED 102 is repetitively switched in a pattern where the current I is passed through the LED 102 until the comparison voltage Vcmp is increased to the reference voltage Vref which exhibits the change in proportion to the change of the full wave rectified voltage Srec, and interrupted when the comparison voltage Vcmp exceeds the reference voltage Vref. Then, an envelope of the current I will be changed in synchronism with the full wave rectified voltage Srec. In other words, a conduction angle of the current I flowing through the LED 102 is broadened, to thereby cause the current I to be changed substantially in phase with the alternating current voltage Sin, which can bring about an increase in a power factor of a lighting system. In addition, reactive power can be reduced, and a harmonic current can be accordingly reduced.

It should be noted that there is a possibility of the reference voltage Vref becoming excessively high depending on the alternating current voltage Sin. In view of this possibility, a zener diode 42*a* may be provided, as shown in FIG. 1, in the voltage dividing circuit 42 to clamp the reference voltage Vref to a predetermined voltage Vmax or lower.

On the other hand, when the full wave rectified voltage Vrec applied to the LED 102 is too low, light emission might become unstable. For example, when the alternating current voltage Sin is a sinusoidal voltage of 100 volts RMS, the LED 102 might perform, in some cases, unstable light emitting operation at voltages in a range where the full wave rectified voltage Vref is 20 V (approximately one fifth of the RMS) or lower.

Figure 3:
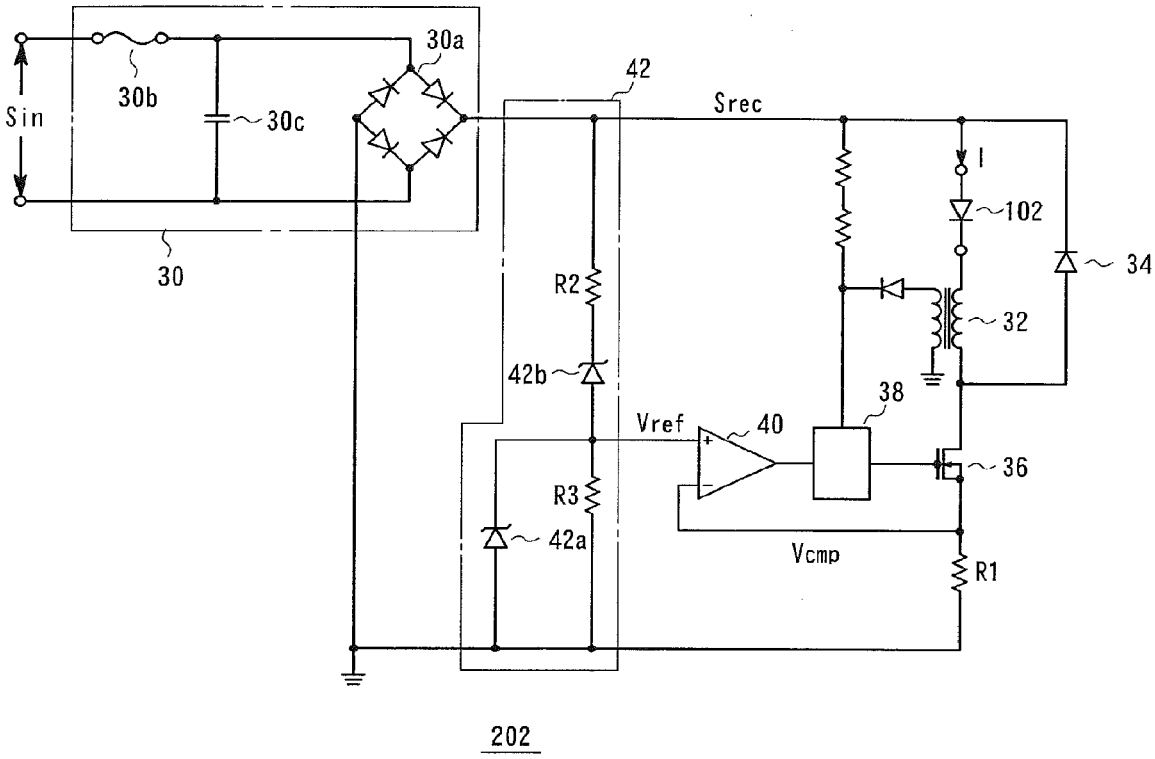
FIG. 3 shows another example of the configuration of the control circuit for the light emitting device according to the first embodiment.
Figure 4:
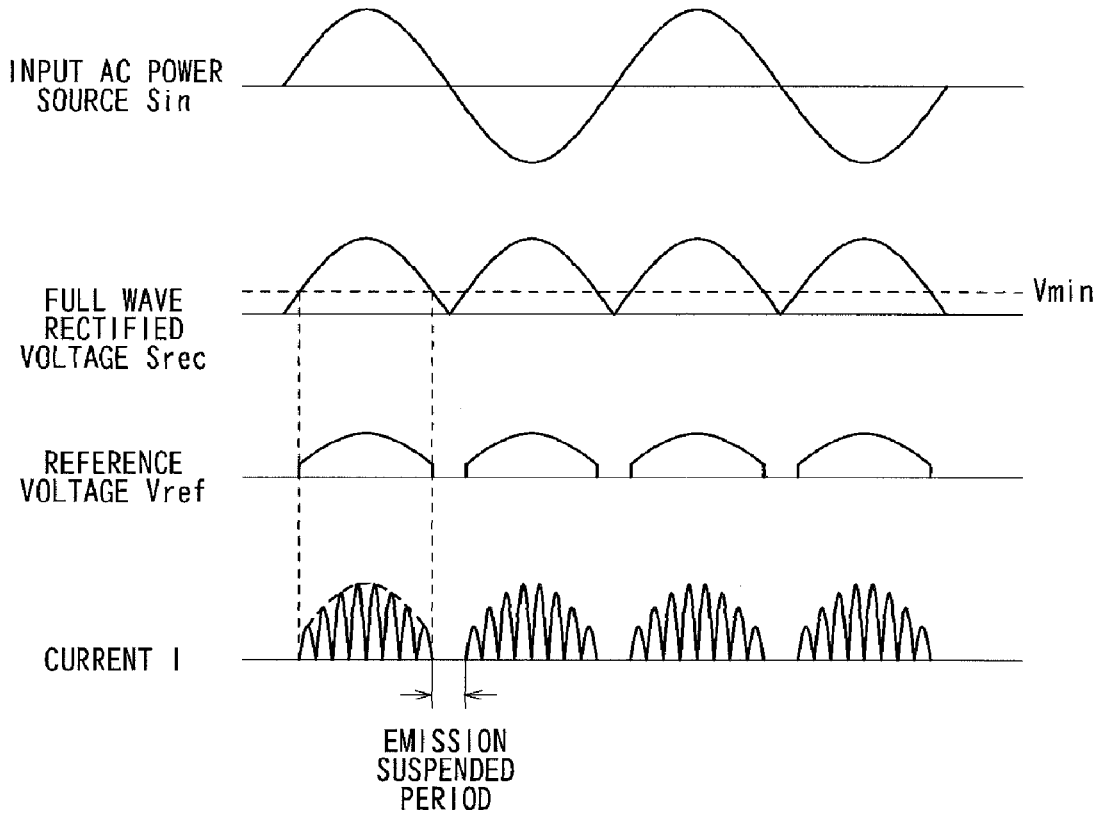
FIG. 4 shows another example of the operation of the control circuit for the light emitting device according the first embodiment.

With this in view, a zener diode 24*b* may be installed, as shown in FIG. 3, in the voltage dividing circuit 42 to interrupt the voltage dividing circuit 42 when the full wave rectified voltage Srec becomes a predetermined voltage value Vmin or lower. More specifically, the zener diode 42*b* whose breakdown voltage is equal to the voltage value Vmin may be inserted between the serially-connected resistances R2 and R3 in such a manner that the zener diode 42*b* is positioned on a high voltage side of the non-inverting input terminal of the comparator 40. As shown in FIG. 4, when the full wave rectified voltage Srec is increased above the voltage value Vmin, the reference voltage Vref has a value that varies in response to the change of the full wave rectified voltage Srec. On the other hand, when the full wave rectified voltage Srec is decreased to the voltage value Vmin or lower, the zener diode 42*b* is shut off, with a result that the reference voltage Vref becomes a ground potential.

In this way, when the full wave rectified voltage Srec is lower than or equal to the breakdown voltage value Vmin of the zener diode 42*b*, because the reference voltage Vref is equal to the ground potential, the switching element 36 is switched to an off position, thereby preventing the LED 102 from emitting light. On the other hand, when the full wave rectified voltage Srec becomes higher than the breakdown voltage value Vmin of the zener diode 42*b*, because the reference voltage Vref has the value that varies in accordance with the full wave rectified voltage Srec, the switching element 36 is switched to an on position and maintained in the on position until the comparison voltage Vcmp is increased to the reference voltage Vref, and then switched off when the comparison voltage Vcomp exceeds the reference voltage Vref. This pattern in which the switching element 36 is switched between the on position and the off position is repeated. The current I to be passed through the LED 102 is caused to flow in response to switching control of the switching element 36 as shown in FIG. 4.

When the zener diode 42*b* is installed as described above, it becomes possible to suspend light emission under a low voltage condition where the LED 102 performs unstable light emitting operation.

<Embodiment 2>

Figure 5:
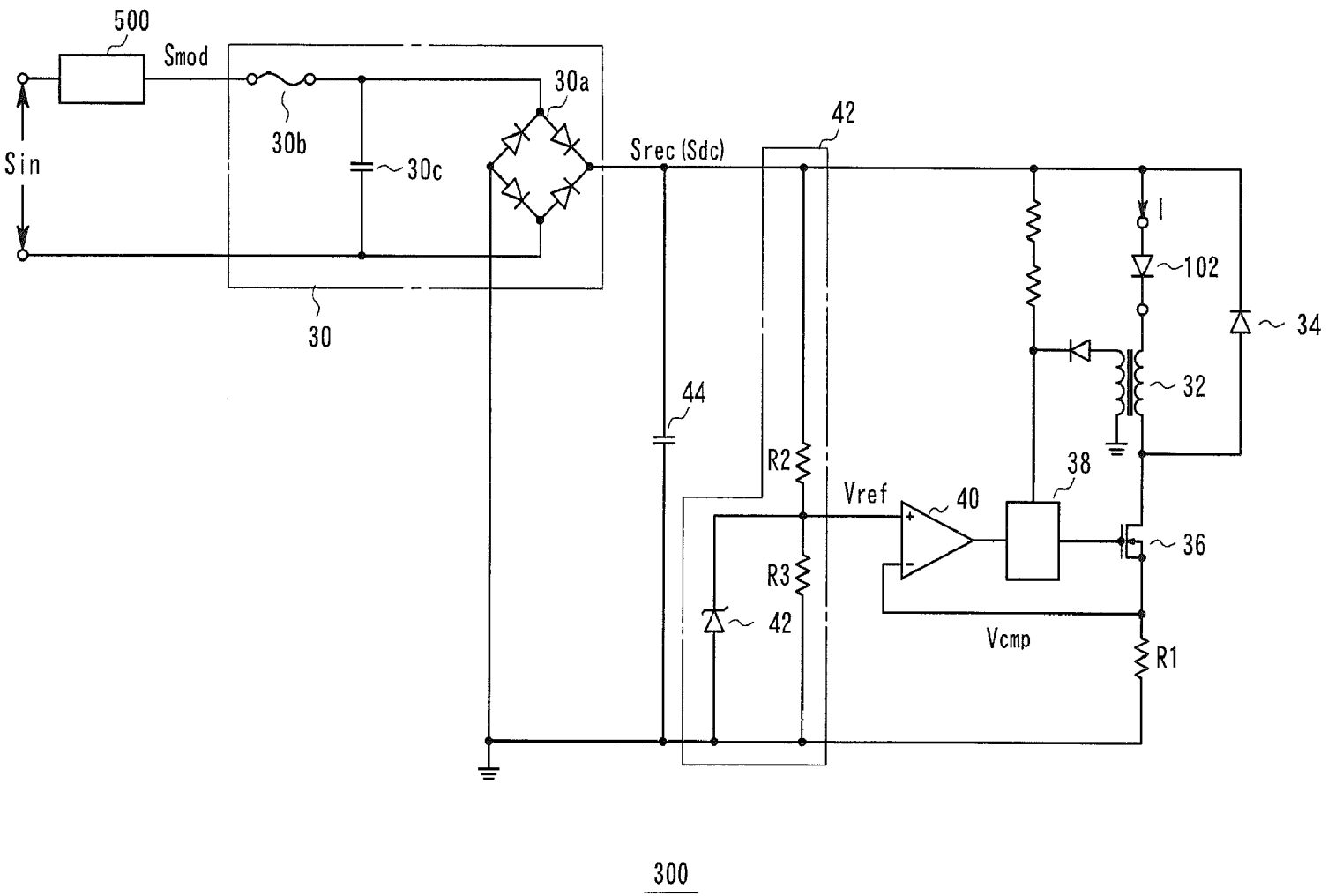
FIG. 5 shows a configuration of a control circuit for a light emitting device according to a second embodiment.
Figure 6:
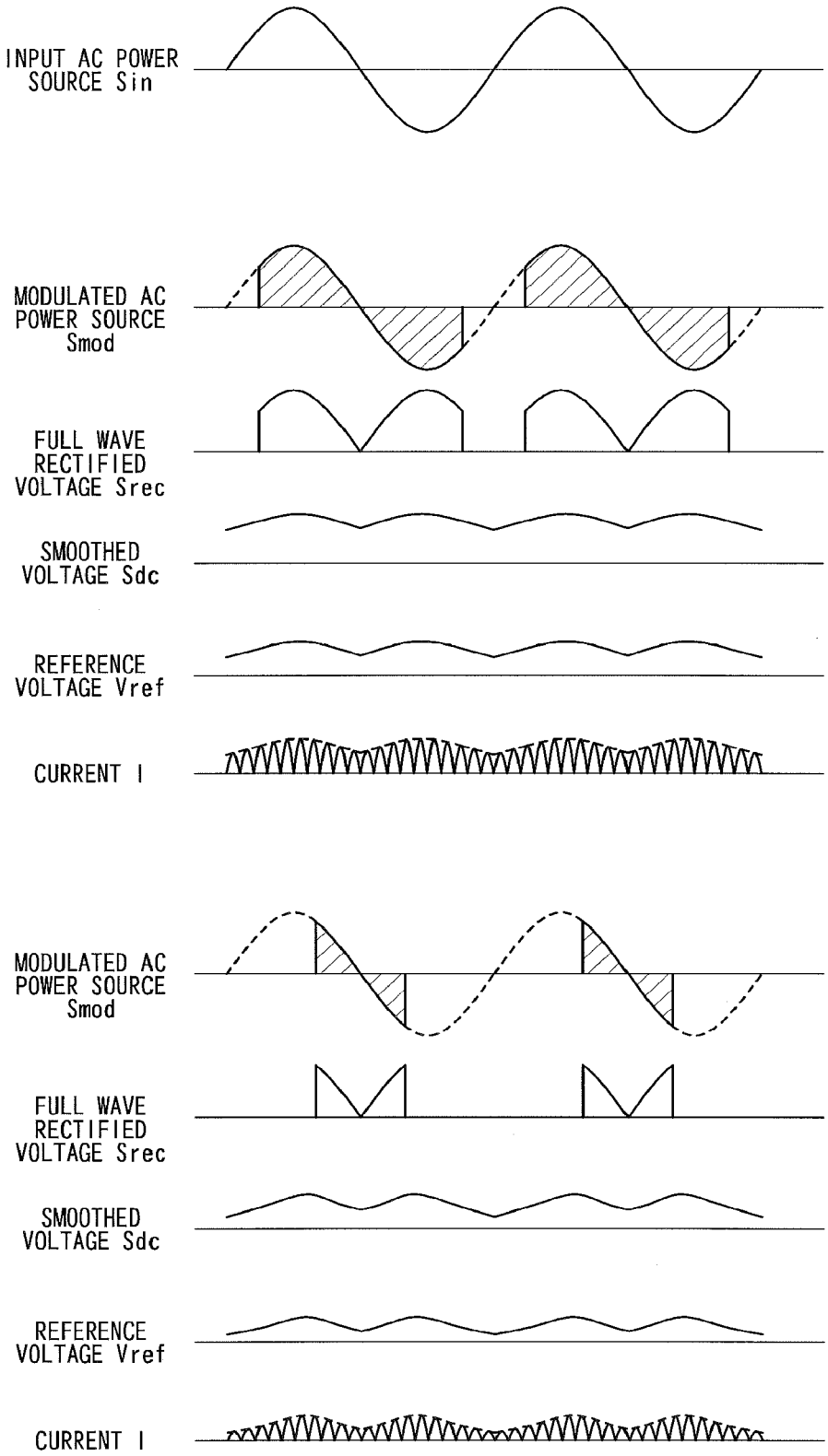
FIG. 6 shows operation of the control circuit for the light emitting device according to the second embodiment.

A control circuit 300 for the light emitting device according to Embodiment 2 of the present invention includes, as shown in FIG. 5, the rectifier unit 30, the choke coil 32, the regenerative diode 34, the switching element 36, the control unit 38, the comparator 40, the voltage dividing circuit 42, and a smoothing capacitor 44. In addition, FIG. 6 shows the voltage/current of each unit in the control circuit 300 according to Embodiment 2.

The control circuit 300 controls light emission of the light emitting device. For example, the control circuit 300 is connected to the light emitting diode (LED) 102 for use in lighting, to control flow of current to the LED 102.

In addition, the control circuit 300 is used in a condition where it is connected to a light intensity adjusting circuit 500 which is used in a dimmer system for an incandescent light bulb, to control a conduction angle of the alternating current voltage Sin. The light intensity adjusting circuit 500 is connected to the rectifier unit 30 in the control circuit 300. More specifically, the light intensity adjusting circuit 500 receives the alternating current voltage Sin, adjusts the conduction angle of the received alternating current voltage Sin based on a signal for modulating a light intensity level or other parameters, and outputs a modulated alternating current voltage Smod.

In Embodiment 2, the same components as those of Embodiment 1 illustrated in FIG. 1 are designated by the same reference characters as those of Embodiment 1, and the descriptions related to the components will not be repeated.

A large-capacitance smoothing capacitor 44 is installed in the subsequent stage of the rectifier unit 30. Then, the full wave rectified voltage Srec is smoothed and output as a smoothed voltage Sdc. As a result, an average value of the modulated alternating current voltage Smod obtained by adjusting the conduction angle of the alternating current voltage Sin is reflected in the smoothed voltage Sdc. When the LED 102 is operated to emit light with the smoothed voltage Sdc, light intensity of the LED 102 can be adjusted by means of the light intensity adjusting circuit 500.

The voltage dividing circuit 42 divides the smoothed voltage Sdc received at the rectifier unit 30 to generate the reference voltage Vref, and outputs the reference voltage Vref to the comparator 40. The voltage dividing circuit 42 may be composed of, for example, the resistances R2 and R3 connected in series. The smoothed voltage Sdc is divided between the resistances R2 and R3, and the terminal voltage of the resistance R3 is input as the reference voltage Vref to the non-inverting input terminal of the comparator 40. Due to the voltage dividing circuit 42, the reference voltage Vref exhibits a change in proportion to a change in the smoothed voltage Sdc as shown in FIG. 6.

The current I flowing through the LED 102 is repetitively switched by the action of both the comparator 40 and the control unit 38 in a pattern where the current I is fed to the LED 102 until the comparison voltage Vcmp is increased to the reference voltage Vref corresponding to the smoothed voltage Sdc, and interrupted when the comparison voltage Vcmp exceeds the reference voltage Vref. In this way, it becomes possible to feed the current I which corresponds to the smoothed voltage Sdc without exceeding a current rating of the LED 102.

Further, because the reference voltage Vref has a value corresponding to the smoothed voltage Sdc which changes in accordance with a level of light intensity adjusted by the light intensity adjusting circuit 500, an average value of the current I flowing through the LED 102 will also be adjusted in accordance with the level of light intensity adjusted by the light intensity adjusting circuit 500. In this way, the light intensity of the LED 102 can also be controlled through adjustment of light intensity performed by the light intensity adjusting circuit 500.

It should be noted that there is a possibility that the reference voltage Vref will become excessively high depending on the alternating current voltage Vsin to be input. In view of this possibility, the zener diode 42*a* may be installed, as shown in FIG. 5, in the voltage dividing circuit 42 to clamp the reference voltage Vref to the predetermined voltage Vmax or lower.

<Embodiment 3>

Figure 7:
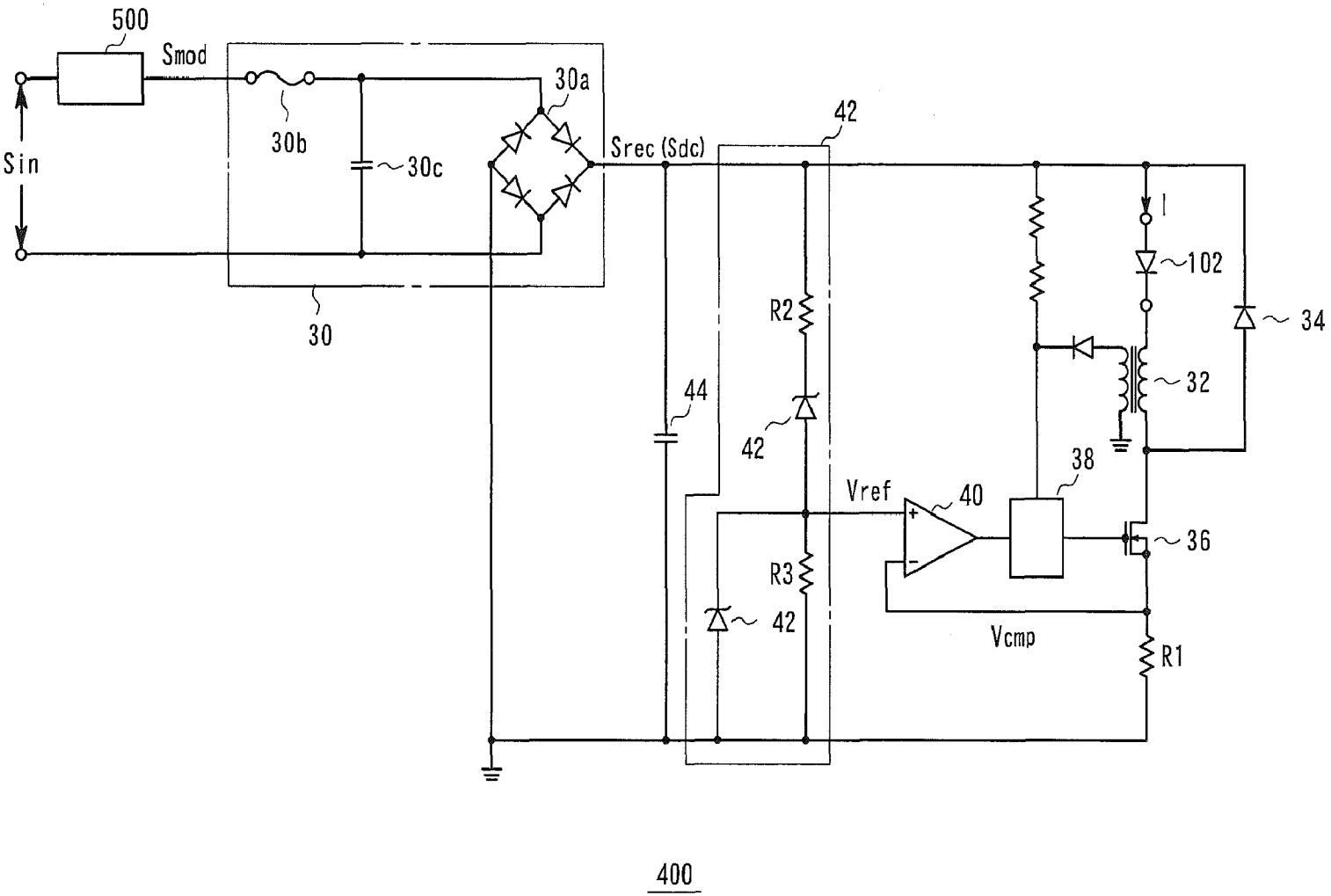
FIG. 7 shows a configuration of a control circuit for a light emitting device according to a third embodiment.
Figure 8:
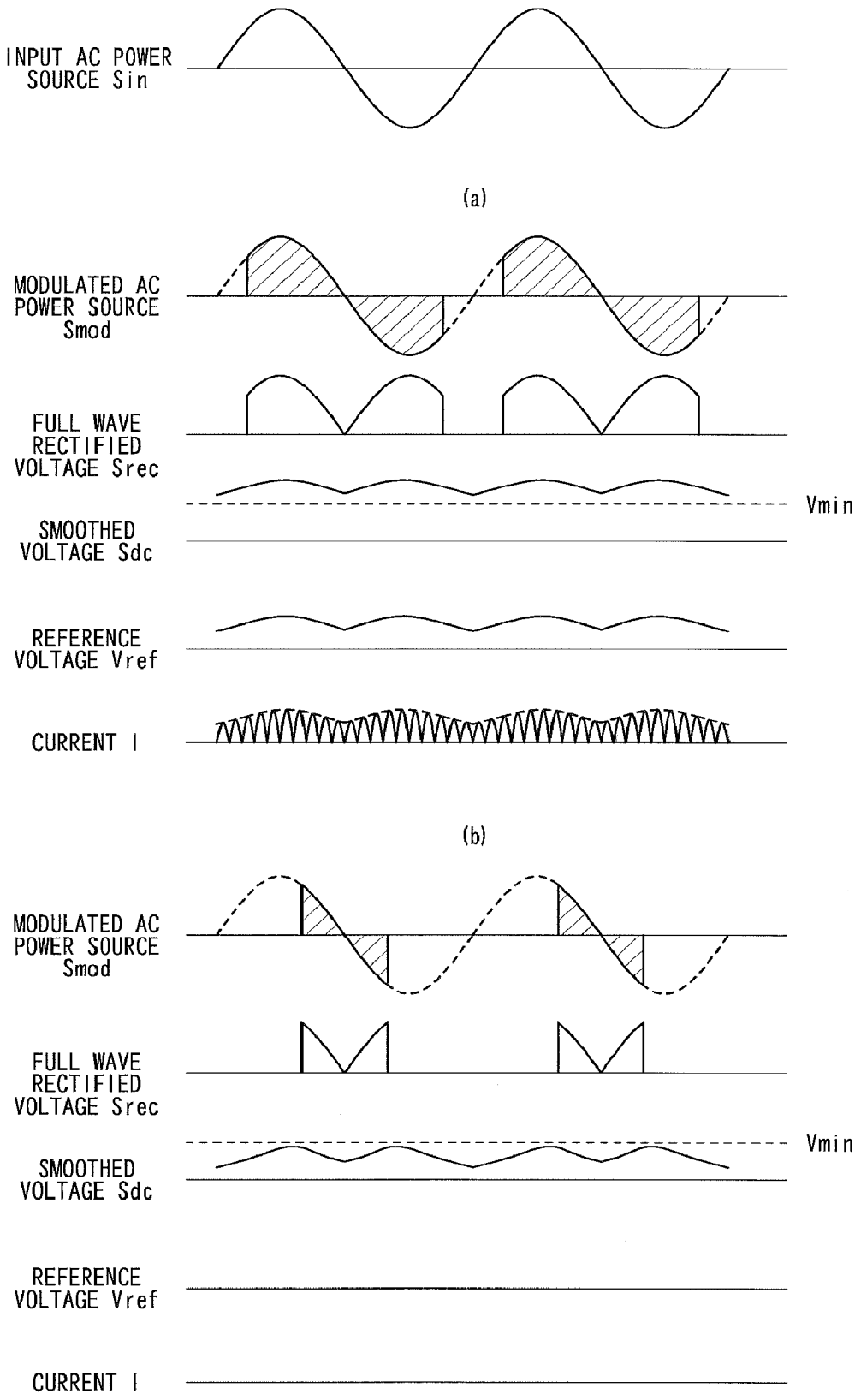
FIG. 8 shows operation of the control circuit for the light emitting device according to the third embodiment.

A control circuit 400 for the light emitting device according to Embodiment 3 of the present invention includes, as shown in FIG. 7, the rectifier unit 30, the choke coil 32, the regenerative diode 34, the switching element 36, the control unit 38, the comparator 40, the voltage dividing circuit 42, and the smoothing capacitor 44. Further, the voltage/current of each unit in the control circuit 400 according to this embodiment is shown in FIG. 8.

The control circuit 400 controls emission of the light emitting device. For example, the control circuit 400 may be connected to the light emitting diode (LED) 102 for use in lighting, to control the flow of current to the LED 102.

In addition, the control circuit 400 is used in a condition where it is connected to the light intensity adjusting circuit 500 which is used in the dimmer system for the incandescent light bulb to control the conduction angle of the alternating current voltage Sin. The light intensity adjusting circuit 500 is connected to the rectifier unit 30 in the control circuit 400. More specifically, the light intensity adjusting circuit 500 receives the alternating current voltage Sin, adjusts the conduction angle of the alternating current voltage Sin based on the signal for modulating the light intensity level or other parameters, and outputs the modulated alternating current voltage Smod.

In the control circuit 400 according to Embodiment 3, the same components as those of Embodiment I illustrated in FIG. 3 are identified by the same reference characters as those of Embodiment 1, and descriptions related to those components will not be repeated.

The large-capacitance smoothing capacitor 44 is installed in the subsequent stage of the rectifier unit 30. Then, the full wave rectified voltage Srec is smoothed, and output as the smoothed voltage Sdc. As a result, the average value of the modulated alternating current voltage Smod obtained by adjusting the conduction angle of the alternating current voltage Sin is reflected in the smoothed voltage Sdc. The emission intensity of the LED 102 can be adjusted using the light intensity adjusting circuit 500 by causing the LED 102 to emit light with the smoothed voltage Sdc.

The anode terminal of the LED 102 is supplied with the smoothed voltage Sdc. The cathode terminal of the LED 102 is connected to ground via the choke coil 32, the switching element 36, and the voltage detecting resistance R1.

The choke coil 32 is provided to shape the current that flows through the LED 102 and the switching element 36 in the form of an interrupted current. As shown in FIG. 7, the forward winding may be installed in the choke coil 32 to allow additional provision of the power source voltage to the control unit 38.

The switching element 36 is installed for the purpose of supplying/interrupting the current to the LED 102. The switching element 36 is configured as an element having a capacity corresponding to power consumption of the LED 102, and may be implemented using, for example, a power field effect transistor having high power or the like. Switching of the switching element 36 is controlled by the control unit 38.

The regenerative diode 34, which is the flywheel diode, is connected in parallel with the LED 102 and the choke coil 32. The regenerative diode 34 sends the energy having been accumulated in the choke coil 32 to the LED 102 for generative use when the switching element 36 is interrupted.

The voltage dividing circuit 42 divides the smoothed voltage Sdc received at the rectifier unit 30 to generate the reference voltage Vref, and outputs the reference voltage Vref to the comparator 40. The voltage dividing circuit 42 may be implemented, for example, by a serial connection of the resistances R2, R3, and the zener diode 42*b*. The non-inverting input terminal of the comparator 40 is connected via the resistance R2 and the zener diode 42*b* to the high voltage side of the rectifier unit 30, and is also connected via the resistance R3 to ground.

The zener diode 42*b* is installed in the voltage dividing circuit 42 in order to interrupt the voltage dividing circuit 42 when the smoothed voltage Sdc becomes lower than or equal to the predetermined voltage value Vmin. Specifically, the zener diode 42*b* whose breakdown voltage is equal to the voltage value Vmin is used. As shown in FIG. 8A, when the smoothed voltage Sdc is increased above the voltage value Vmin due to adjustment in the light intensity adjusting circuit 500, the reference voltage Vref has a value that changes in accordance with the change of the smoothed voltage Sdc. At this time, the smoothed voltage Sdc is divided among the resistances R2, R3, and the zener diode 42*b*, and the terminal voltage of the resistance R3 is input as the reference voltage Vref into the non-inverting input terminal of the comparator 40. Due to the voltage dividing circuit 42, as shown in FIG. 8A, the reference voltage Vref exhibits a change in proportion to the change in the smoothed voltage Sdc. On the other hand, as shown in FIG. 8B, when the smoothed voltage Sdc is decreased to the voltage value Vmin or lower, the zener diode 42*b* is put into an interrupted state, with a result that the reference voltage Vref becomes equal to the ground potential.

As shown in FIGS. 8A and 8B, switching of the current I that flows through the LED 102 is controlled by the action of both the comparator 40 and the control unit 38. When the smoothed voltage Sdc is increased above the voltage value Vmin by the adjustment performed in the light intensity adjusting circuit 500, the current I is fed to the LED 102 until the comparison voltage Vcmp is increased to the reference voltage Vref corresponding to the smoothed voltage Sdc, and then interrupted when the comparison voltage Vcmp exceeds the reference voltage Vref. The pattern in which the current I is fed and interrupted is repeated. In this way, it becomes possible to feed the current I which corresponds to the smoothed voltage Sdc without exceeding the current rating of the LED 102. On the other hand, when the smoothed voltage Sdc becomes lower than or equal to the voltage value Vmin, the zener diode 42*b* is put into the interrupted state, with a result that the reference voltage Vref becomes equal to the ground potential, which in turn switches off the switching element 36. In this way, the light emission of the LED 102 is suspended.

Here, when there are a plurality of light intensity adjusting circuits 500 having different minimum output voltages, it is preferable to match the breakdown voltage of the zener diode 42*b* with the highest minimum output voltage among those of the plurality of light intensity adjusting circuits 500. For example, in a case where multiple types of the light intensity adjusting circuits 500 with minimum average output voltages ranging from 60 V to 30 V are present, the zener diode 42*b* having a breakdown voltage of 60 V is used.

Figure 9A:
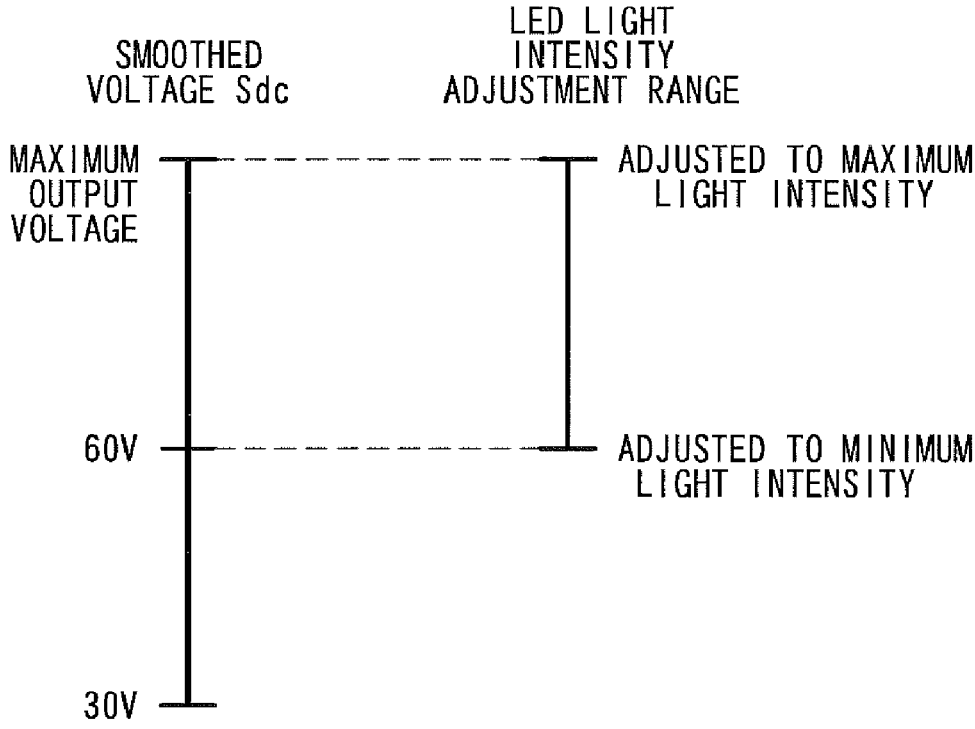
FIG. 9A is a diagram for explaining operation of controlling the light emitting device to a state of minimum light intensity according to the third embodiment.
Figure 9B:
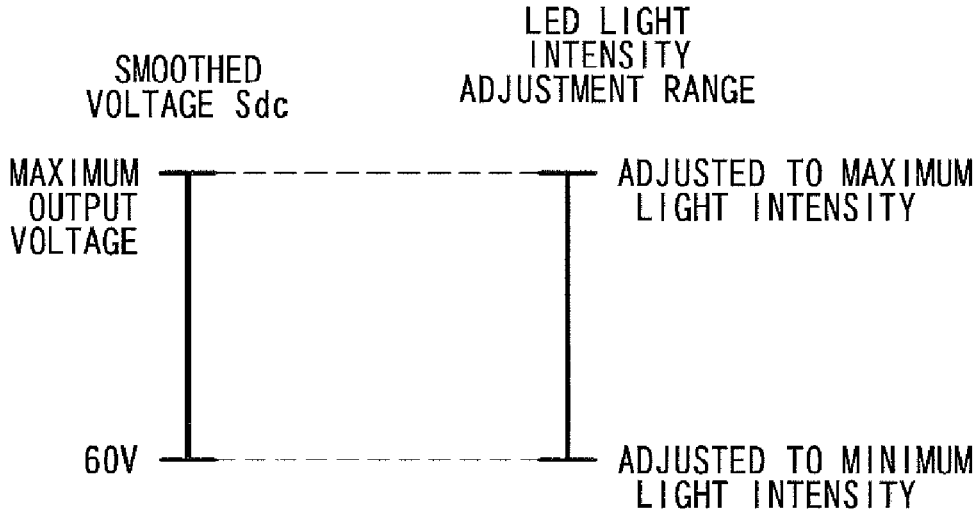
FIG. 9B is a diagram for explaining operation of controlling the light emitting device to the state of minimum light intensity according to the third embodiment.

In this way, the control circuit 400 functions as a circuit for controlling emission of the LED 102 within a voltage range in which the smoothed voltages Sdc is higher than 60 V. More specifically, when the smoothed voltage Sdc is lower than 60 V, because the reference voltage Vref is equal to the ground potential, the switching element 36 is in the off position where the LED 102 does not emit light. On the other hand, when the output voltage of the light intensity adjusting circuit 500 becomes higher than 60 V, because the reference voltage Vref has the value corresponding to the smoothed voltage Sdc, the switching element 36 is switching controlled. As a result, the LED 102 is driven at the emission intensity in accordance with the output voltage of the light intensity adjusting circuit 500. That is to say, regardless of whether the output range of the light intensity adjusting circuit 500 is in a range of from 30 V to the maximum output voltage as shown in FIG. 9A, or in a range of from 60 V to the maximum output voltage as shown in FIG. 9B, the LED 102 can be adjusted from the state of minimum light intensity (the darkest state) to the state of maximum light intensity (the brightest state) in the range of output voltages of the light intensity adjusting circuit 500 from 60 V to the maximum output voltage.

Here, in view of the possibility that the reference voltage Vref may become excessively high depending on the alternating current voltage Sin to be input, the zener diode 42*a* may be installed in the voltage dividing circuit 42 to clamp the reference voltage Vref to the predetermined voltage Vmax or lower.

Figure 10:
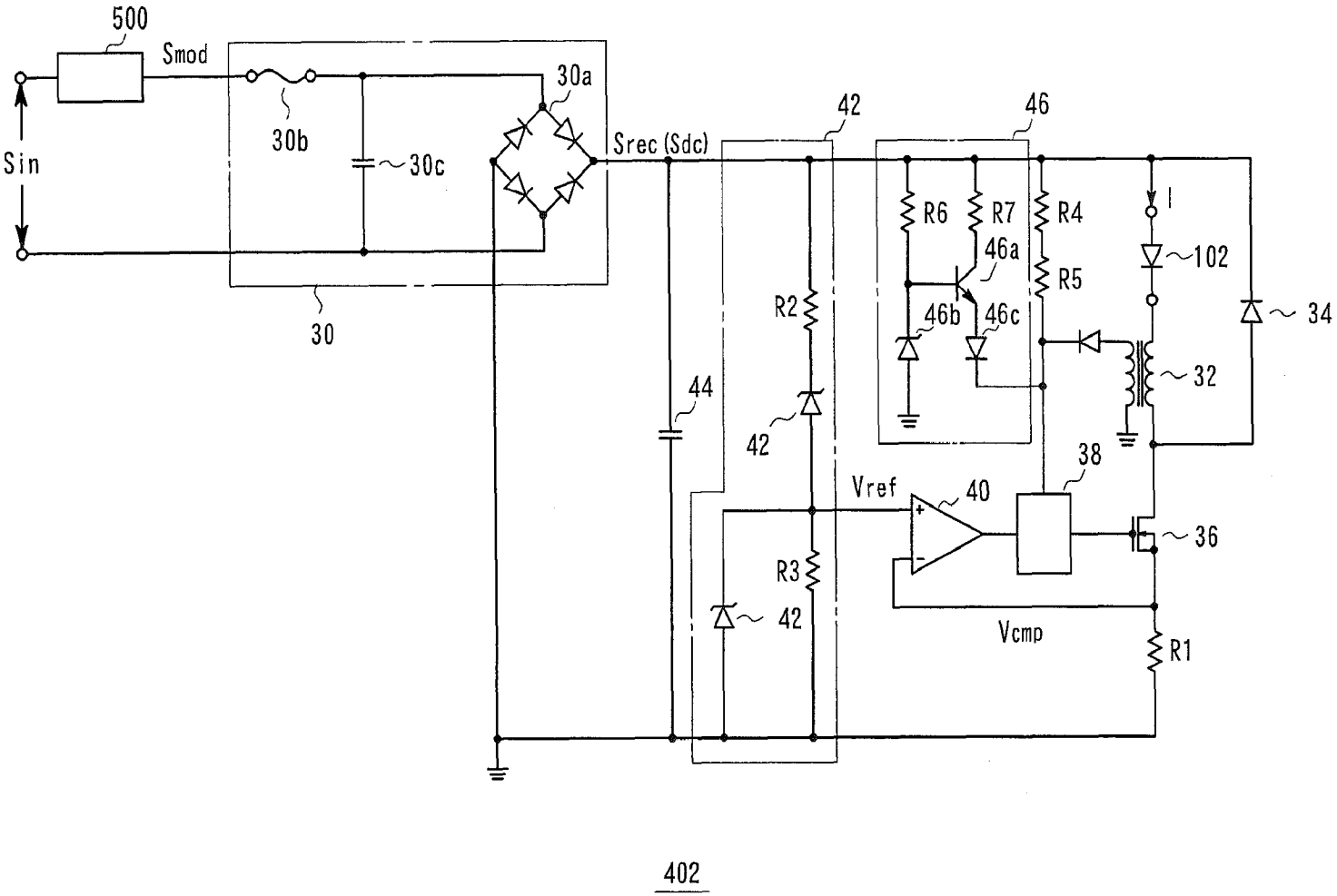
FIG. 10 shows another example of the configuration of the control circuit for the light emitting device according to the third embodiment.
Figure 11:
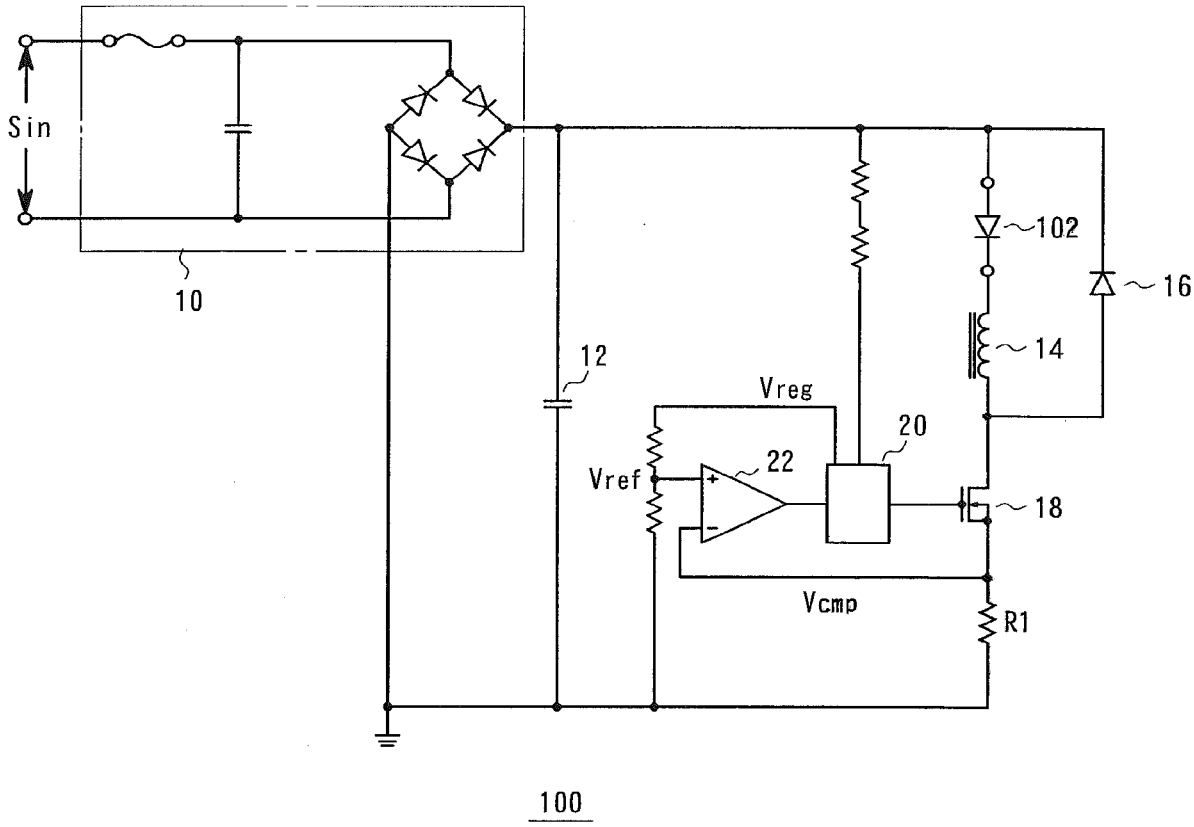
FIG. 11 Related Art
FIG. 11 shows a configuration of a control circuit for a light emitting device in related art.
Figure 12:
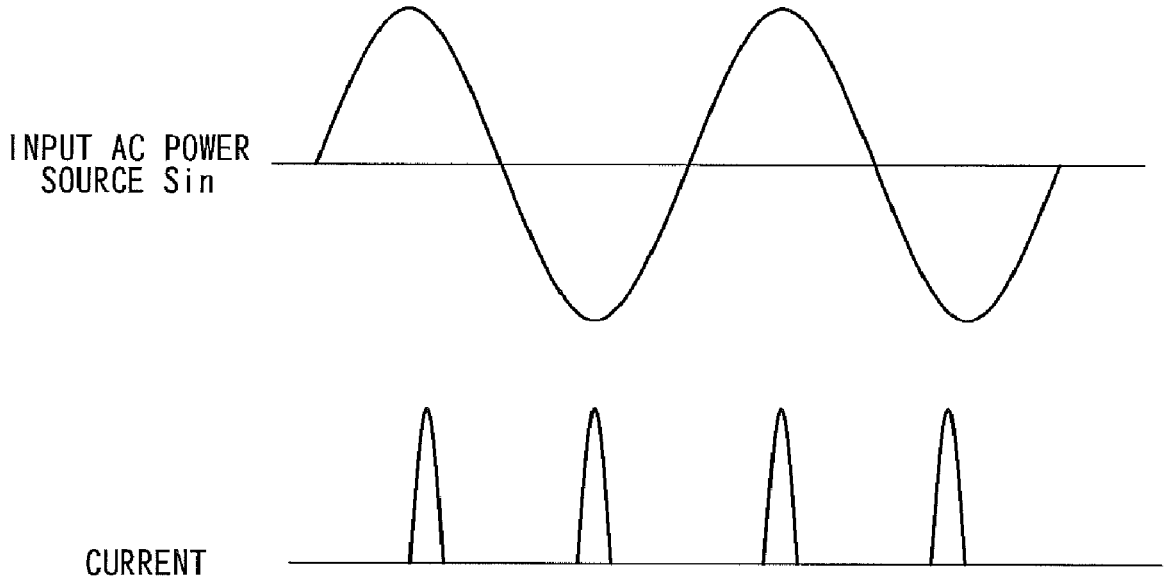
FIG. 12 Related Art
FIG. 12 shows operation of the control circuit for the light emitting device in related art.
Figure 13:
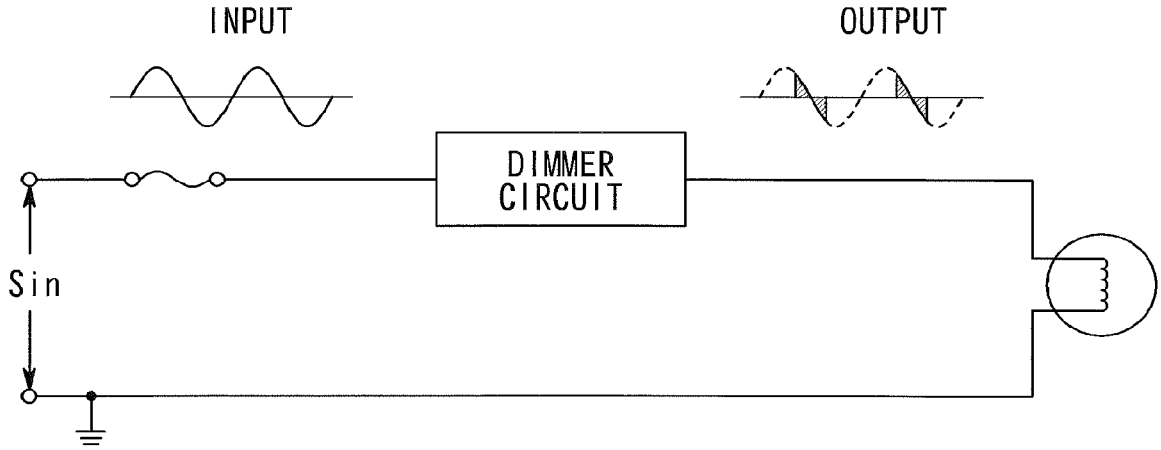
FIG. 13 Related Art
FIG. 13 shows a configuration of a dimmer circuit for an incandescent light bulb in related art.

Meanwhile, it is necessary for the power source voltage to be continuously supplied to the control unit 38 until the output from the light intensity adjusting circuit 500 matches an off voltage even in a state where the smoothed voltage Sdc is adjusted to a lower value by the light intensity adjusting circuit 500. For this purpose, it is preferable to configure a control circuit 402 including a power supply circuit 46 as shown in FIG. 10.

The power source voltage is supplied to the control unit 38 by a route passing through the resistances R4 and R5 in a state where the output voltage from the light intensity adjusting circuit 500 is high. However, as the output voltage from the light intensity adjusting circuit 500 is decreased, the power source voltage supplied by the route passing through the resistances R4 and R5 will be insufficient. With this in view, the power supply circuit 46 is installed in parallel with the resistances R4 and R5 in the control circuit 402.

The power supply circuit 46 includes resistances R6, R7, a transistor 46*a*, a zener diode 46*b*, and a diode 46*c*. When the output voltage from the light intensity adjusting circuit 500 is decreased, the voltage supplied as the power source voltage to the control unit 38 by the resistances R4 and R5 is decreased, which brings the diode 46*c* into conduction. Then, an emitter voltage of the transistor 46*a* is also decreased, and a current is supplied via the resistance R6 to a base of the transistor 46*a*, thereby bringing the transistor 46*a* into conduction. As a result, the power source voltage is supplied via the resistance R7, a collector-emitter of the transistor 46*a*, and the diode 46*c* to the control unit 38. On the other hand, when the output voltage from the light intensity adjusting circuit 500 is increased, the power source voltage applied to the control unit 38 through the resistances R4 and R5 becomes sufficiently high, and the emitter voltage of the transistor 46*a* is also increased, which brings the transistor 46*a* out of conduction.

In this way, because the power source voltage can be supplied to the control unit 38 in response to a wide range of output voltages obtained from the light intensity adjusting circuit 500, the control circuit 402 can be operated in a stable manner.

As has been described above, when the control circuit for the light emitting device according to the embodiments of the present invention is used, emission of the LED can be reliably adjusted to the state of minimum light intensity using the circuit for adjusting light intensity which has been conventionally used for the incandescent light bulb.

What is claimed is:

1. A control circuit for a light emitting device, comprising:

a rectifier unit for performing full wave rectification on an alternating current power source;

a capacitor for smoothing a voltage having been full wave rectified in the rectifier unit;

a first switching element for switching a current flowing through the light emitting device which emits light in response to the smoothed voltage;

a voltage dividing circuit that includes a zener diode for interrupting the voltage dividing circuit when the smoothed voltage is decreased to a first voltage or lower, and divides the smoothed voltage to output a reference voltage when the smoothed voltage is higher than the first voltage;

a comparator for comparing a comparison voltage corresponding to the current flowing through the light emitting device with the reference voltage, a control unit for controlling switching of the first switching element based on a comparison result obtained in the comparator; and a power supply circuit including a second switching element which is brought into conduction when the smoothed voltage is lower than a second voltage, and brought out of conduction when the smoothed voltage is higher than the second voltage, wherein the power supply circuit supplies the smoothed voltage via the second switching element to the control unit as a power source voltage.

2. A control circuit for a light emitting device, comprising:

a rectifier unit for performing full wave rectification on an alternating current power source;

a capacitor for smoothing a voltage having been full wave rectified in the rectifier unit;

a first switching element for switching a current flowing through the light emitting device which emits light in response to the smoothed voltage;

a voltage dividing circuit that includes a zener diode for interrupting the voltage dividing circuit when the smoothed voltage is decreased to a first voltage or lower, and divides the smoothed voltage to output a reference voltage when the smoothed voltage is higher than the first voltage;

a comparator for comparing a comparison voltage corresponding to the current flowing through the light emitting device with the reference voltage, a control unit for controlling switching of the first switching element based on a comparison result obtained in the comparator; and a power supply circuit including a second switching element which is brought into conduction when the smoothed voltage is lower than a second voltage, and brought out of conduction when the smoothed voltage is higher than the second voltage, wherein the power supply circuit supplies the smoothed voltage via the second switching element to the control unit as a power source voltage;

wherein the control unit controls the first switching element to a position where the first switching element allows the current to flow through the light emitting device when the comparison voltage is higher than the reference voltage, or a position where the first switching element prevents the current from flowing through the light emitting device when the comparison voltage is lower than the reference voltage.

* * * * *